United States Patent [19]

Maurer et al.

[11] Patent Number: 4,500,250

[45] Date of Patent: Feb. 19, 1985

[54] BACKHOE SWING MECHANISM

[75] Inventors: Herman J. Maurer; Carl O. Pedersen; Barry C. Nudd, all of Burlington, Iowa

[73] Assignee: J. I. Case Company, Racine, Wis.

[21] Appl. No.: 385,784

[22] Filed: Jun. 7, 1982

[51] Int. Cl.[3] ..... E02F 3/32

[52] U.S. Cl. ..... 414/695.5; 91/176; 91/178; 91/185

[58] Field of Search ..... 414/695.5, 694; 91/176, 91/178, 183, 185

[56] References Cited

U.S. PATENT DOCUMENTS

| | | | |
|---|---|---|---|
| 4,065,010 | 12/1977 | Worback | 414/694 |
| 4,341,501 | 7/1982 | Maurer et al. | 414/694 |
| 4,389,153 | 6/1983 | Pedersen et al. | 414/695.5 |
| 4,403,905 | 9/1983 | Maurer et al. | 91/176 |
| 4,419,040 | 12/1963 | Pedersen et al. | 414/687 |

*Primary Examiner*—Robert J. Spar
*Assistant Examiner*—Donald W. Underwood
*Attorney, Agent, or Firm*—Dressler, Goldsmith, Shore, Sutker & Milnamow, Ltd.

[57] ABSTRACT

An improved hydraulic swing mechanism is disclosed for operation of the boom assembly of a backhoe or similar implement. The swing mechanism includes a pair of double-acting hydraulic motors pivotally interconnected between the backhoe frame and the backhoe boom assembly. A novel multi-position sequencing spool valve is disposed in fluid communication between the head ends of the hydraulic motors and a manually operated directional control valve which directs swinging movement of the boom assembly. A straight-forward valve control linkage operatively connects the sequencing spool valve with the boom assembly so that the spool valve is selectively operated as the boom assembly is pivoted through its arc of travel. An improved hydraulic cushioning circuit is provided in association with the sequencing spool valve, with the entire system providing improved operation of the boom assembly, with significant improvement in the hydraulic cushioning and torque characteristics of the system.

9 Claims, 10 Drawing Figures

BACKHOE SWING MECHANISM

CROSS-REFERENCE TO RELATED APPLICATIONS

The present invention is related to U.S. Pat. Nos. 4,341,501; 4,403,905; 4,389,153; and 4,419,040.

TECHNICAL FIELD

The present invention relates generally to material-handling and excavation equipment, and more particularly to an improved hydraulic swing mechanism for pivoting the boom assembly of a backhoe or like implement.

BACKGROUND OF THE INVENTION

A typical backhoe includes a frame which may be mounted on the rear of a tractor or like implement, the frame supporting a boom assembly for pivotal movement with respect to the frame about a vertical axis. The boom assembly includes a bucket or other material-handling device for work operations, with articulation of the boom assembly by the backhoe operator providing material-handling in the desired fashion.

Backhoes and like excavators are used for a wide variety of material handling and excavation operations, and the business is highly competitive in nature. It is necessary that work operations be efficiently performed with the backhoe, and thus any way in which to shorten the cycle of filling the bucket, moving the boom assembly, dumping the bucket, and returning to repeat the cycle is very desirable.

In early backhoe designs, it was typically the practice of the backhoe operator to swing the boom assembly of the backhoe hard against the mechanical travel stops limiting the pivotal movement of the boom assembly. While this practice helped to reduce the time for each work cycle of the machine, this practice was found to be very detrimental to the components of the unit. If the operator exercised greater care during operation by manipulating the boom swing control to slow the assembly before it reached the travel stop, shock loading of the machine's components was reduced, but the extra care exercised by the operator increased the time for completing each cycle of backhoe operation.

In order to alleviate the problems caused by shock loading of the backhoe as the boom assembly contacted its mechanical travel stop, various arrangements have been employed to provide hydraulic cushioning of the boom assembly as it approaches the ends of its arc of travel. One type of arrangement is commonly referred to as a "stinger," which comprises a projection carried by the piston of each hydraulic motor provided for swinging the boom assembly. As the boom assembly of the backhoe approaches the ends of its arc of travel, the stinger of one of the hydraulic motors acts to restrict the flow of hydraulic fluid from that motor, thus providing hydraulic cushioning of the boom assembly. Frequently, a stinger arrangement is used in conjunction with a flow restricting orifice positioned in each motor which restricts hydraulic fluid flow from the motors to hydraulically cushion the boom assembly. While combination stinger/orifice cushioning arrangements are widely used today, their fabrication and maintenance has proven to be relatively expensive.

Another problem of conventional backhoe design relates to the relative positioning of the hydraulic motors of the boom swing mechanism and the resultant torque applied to the boom assembly. Spacial limitations are a major consideration in positioning the hydraulic motors of the swing mechanism, so the motors are usually positioned generally adjacent each other, and pivotally interconnected between the frame of the backhoe and the boom assembly. In order to obtain the desired range of travel for the boom assembly (approximately 180 degrees), this configuration of swing mechanism results in one or the other of the hydraulic motors moving through a fully extended position when the boom assembly is moved beyond either end of a central range of travel of approximately 90 degrees. This fully extended position is frequently referred to as the "center" position for that hydraulic motor. As the boom assembly is moved toward the ends of its arc of travel, one of the hydraulic motors moves through its fully extended center position and goes "overcenter", and then begins to contract. Each hydraulic motor of the swing mechanism moves through its center position when its centerline intersects the vertical swinging axis of the boom assembly.

As one of the hydraulic motors of the swing mechanism moves to and through its center position, the moment arm through which it acts upon the boom assembly approaches zero at the center position, with the overcenter hydraulic motor then exerting a negative torque on the boom assembly. Since the other (non-overcenter) hydraulic motor of the swing mechanism acts through a much greater moment arm than the overcenter motor, the boom assembly continues to move through its arc of travel. However, since the overcenter hydraulic motor exerts a negative torque on the boom assembly, the non-overcenter hydraulic motor must work to overcome this negative torque as it provides the primary force for pivoting the boom assembly. The negative torque created by the overcenter one of the hydraulic motors is particularly a problem when swinging movement of the boom assembly away from one of its travel stops is initiated, since inertial forces must be overcome. In this regard, a hydraulic swing mechanism for the boom assembly which includes an arrangement for redirecting the flow of hydraulic fluid to the hydraulic motors during swinging movement of the boom assembly so that the hydraulic motors are not, in essence, acting against each other, provides a more efficient swing mechanism with improved control for the backhoe operator.

Thus, a hydraulic swing mechanism for a boom assembly of a backhoe or like implement which provides improved hydraulic cushioning for the boom assembly, as well as improves the torque characteristics of the arrangement, further enhances the versatility and desirability of these types of material handling implements.

SUMMARY OF THE INVENTION

In accordance with the present invention, an improved hydraulic swing mechanism for pivoting the boom assembly of a backhoe or like implement is disclosed. The mechanism includes a multi-position valve for redirecting the flow of hydraulic fluid to the motors during swinging movement of the boom assembly, and includes a flow restricting, hydraulic cushioning arrangement disposed separately from the hydraulic motors of the swing mechanism. The present invention thereby provides improved hydraulic cushioning for deceleration of the boom assembly as it approaches its travel stops, and further, improves upon the torque characteristics of the hydraulic swing motors for improved efficiency and control of the boom assembly.

The present swing mechanism includes a pair of double acting, hydraulic motors interconnected between the backhoe frame and the boom assembly, each hydraulic motor having a first, piston rod end, and a second, head (or cylinder) end, which respectively define fluid expansible chambers. The extension and contraction of the hydraulic motors pivot the boom assembly of the backhoe about its vertical swinging axis. Each of the hydraulic motors moves through its fully extended, center position when its respective centerline intersects the vertical swinging axis of the boom assembly.

The swing mechanism further includes a hydraulic system including a source of fluid under pressure and a directional control valve for selectively directing fluid under pressure to and from the hydraulic motors. The directional control valve is connected with the rod ends of the hydraulic motors by suitable fluid conduits.

The arrangement further includes a hydraulic sequencing valve hydraulically joined between the head ends of the hydraulic motors and the directional control valve. Essentially, the sequencing valve is in fluid communication with the four ends of the two hydraulic motors. The sequencing valve preferably comprises a multi-position spool valve. Repositioning of the spool valve during movement of the boom assembly through its arc of travel results in re-porting of hydraulic fluid to the hydraulic motors of the swing mechanism to improve the torque characteristics of the system. Preferably, the sequencing valve operatively moves its position generally as either of the hydraulic motors of the swing mechanism moves through its center position.

The present swing mechanism further includes a valve control linkage which operatively connects the sequencing valve with the boom assembly of the backhoe. The valve control linkage cooperates with a centering mechanism provided in the sequencing valve which acts to urge the sequencing valve toward its center position. The valve control linkage includes lost motion means so that repositioning of the sequencing valve only takes place as the boom assembly is moved through the end portions of its arc of travel, generally when one of the hydraulic motors of the mechanisms is overcenter.

In the preferred embodiment, the sequencing spool valve of the present invention includes a hydraulic cushioning circuit. The cushioning circuit cooperates with the spool valve to provide restriction of fluid flow from the hydraulic motors of the swing mechanism as the boom assembly approaches the ends of its arc of travel. This is a significant improvement upon cushioning arrangements heretofore known in that a single hydraulic cushioning arrangement provides the desired cushioning effect for the hydraulic motors, and thus the boom assembly, without the use of conventional stingers and/or orifices in the hydraulic motors.

The hydraulic cushioning circuit is preferably arranged to restrict flow of fluid in one direction through the circuit, and permit substantially unrestricted fluid flow through the hydraulic cushioning circuit in an opposite direction. The configuration of the cushioning circuit and the sequencing valve provides restriction of fluid flow from the hydraulic swing motors to effect hydraulic cushioning as the boom assembly moves toward its travel stop, and permits substantially unrestricted fluid flow to the motors when the boom assembly is moved away from its travel stop with one of its motors in an overcenter condition. This arrangement provides significant improvements in the operational characteristics of the swing mechanism, and represents a significant improvement on arrangements heretofore known.

As the boom assembly is moved from one end of its arc of travel to the other, the present swing mechanism sequentially operates through three distinct modes by the action of the valve control linkage as the position of the sequencing spool valve is shifted.

In the first operational mode during which swinging movement is initiated, pressurized fluid is ported to both ends of the overcenter one of hydraulic motors, and to the head end of the other non-overcenter motor. The difference in the effective piston surface areas of the respective ends of each motor permits the overcenter motor to provide supplemental torque by pressurizing both its ends. The sequencing valve of the mechanism provides fluid porting in this manner by placing the head ends of the motors in communication with each other, and in communication with the rod end of the overcenter motor across the cushioning circuit. As noted, flow through the cushioning circuit to the hydraulic motors is substantially unrestricted.

In the next operational mode, when neither hydraulic motor is overcenter, the present system ports pressurized fluid to the rod end of one motor, and to the head end of the other motor. Each motor supplies substantial motive force for movement of the boom assembly through the central portion of its arc of travel.

In the last operational mode, as the other of the hydraulic motors goes overcenter and the boom assembly approaches its travel stop, hydraulic cushioning of the boom assembly is desired. The present swing mechanism ports pressurized fluid to rod end of the non-overcenter one of the motors for continued movement of the boom assembly, and directs flow from the head ends of both motors through the flow restricting cushioning circuit to effect hydraulic cushioning.

It will be appreciated that operational improvements provided by the present hydraulic swing mechanism are accomplished in a straightforward fashion with relatively uncomplicated control mechanisms. The valve control linkage may be readily fabricated and installed, and the self-centering, sequencing spool valve and associated hydraulic cushioning circuit will be recognized as readily fabricated and maintained. Additionally, the improved torque characteristics provided for operation of the backhoe boom assembly by the present swing mechanism enables the swing mechanism to include so-called end-mounted hydraulic motors, in distinction from trunnion-mounted hydraulic motors typically employed in conventional swing mechanisms. This provides additional benefit in that end mounted motors are generally less expensive than the trunnion-mounted type.

Numerous other advantages and features of the present invention will become readily apparent from the following detailed description of the invention and embodiment thereof, from the claims and from the accompanying drawings in which like numerals are employed to designate like parts throughout the same.

DETAILED DESCRIPTION

Figure 1:
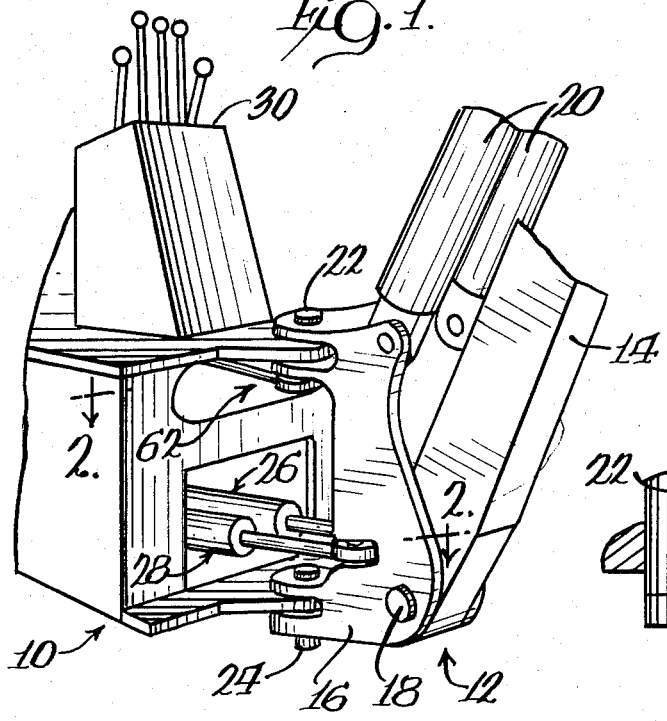
FIG. 1 is a partial perspective view of a backhoe employing the hydraulic swing mechanism of the present invention.

While the present invention is susceptible to embodiment in different forms, there is shown in the drawings and will hereinafter be described a preferred embodiment with the understanding that the present disclosure is to be considered as an exemplification of the principles of the invention and is not intended to limit the invention to the embodiment illustrated.

With reference to FIG. 1, therein is illustrated a material-handling backhoe. While the present invention is disclosed in association with the backhoe, it will be appreciated that the hydraulic operating mechanism in accordance with the teachings of the present invention could be similarly provided in other types of material-handling and earth-working implements in which the operational characteristics provided by the present invention are desired.

As illustrated, the backhoe includes a fixed frame member 10 which pivotally supports the boom assembly 12 for swinging pivotal movement about a vertical axis. Boom assembly 12 includes an elongated boom 14 pivotally supported for movement about a generally horizontal axis on a swing tower 16 by boom pivot 18. A pair of double-acting, hydraulic fluid rams 20 are operatively connected between swing tower 16 and boom 14 for movement of boom 14 about boom pivot 18.

Swing tower 16 is pivotally mounted to frame 10 by an upper pivot 22 and lower pivot 24 which define the vertical axis about which boom assembly 12 is moved during operation of the backhoe. Movement of boom assembly 12 with respect to this vertical axis is provided by a pair of double-acting, hydraulic fluid motors 26 and 28 which are operatively pivotally interconnected between backhoe frame 10 and swing tower 16 of boom assembly 12. Selective operation of fluid rams 20 and fluid motors 26 and 28 by the backhoe operator from control area 30 permits articulation of the boom assembly by the operator in order to perform work operations.

As best illustrated in FIGS. 2, and 5A–C, hydraulic motors 26 and 28 extend between backhoe frame 10 and swing tower 16 with respective ends of each motor pivotally connected with the frame and the swing tower. Cylinder 32 of hydraulic motor 26 is pivotally connected to backhoe frame 10 by pivot 34, while piston (and rod) 36 of hydraulic motor 26 is pivotally connected to swing tower 16 by pivot 38. Similarly, cylinder 40 of hydraulic motor 28 is pivotally connected to backhoe frame 10 by pivot 42, while piston (and rod) 44 of motor 28 is pivotally connected to swing tower 16 by pivot 46. Each motor 26 and 28 includes a first, piston rod end and a second head or cylinder end, which define respective fluid expansible chambers, with selective fluid pressurization of the ends of the motors providing extension and contraction of the motors in order to pivot boom assembly 12 about its vertical pivotal swinging axis.

Figure 5A:
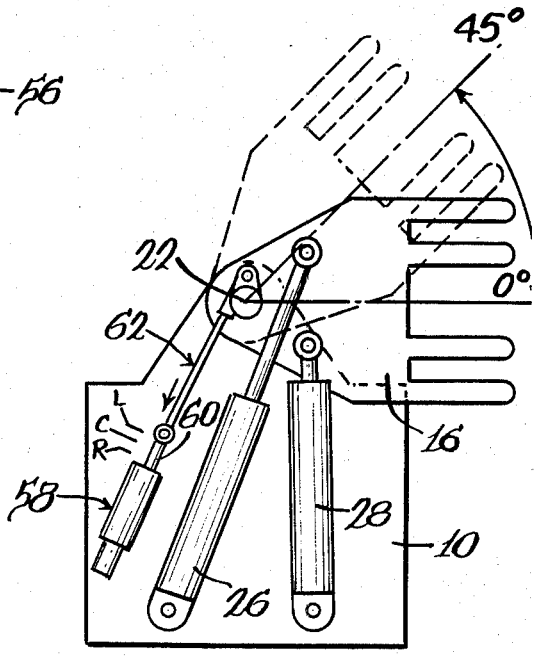
FIGS. 5A–5C illustrate the positions of the hydraulic swing mechanism of the present invention as the backhoe boom is pivoted through its arc of travel.
Figure 5B:
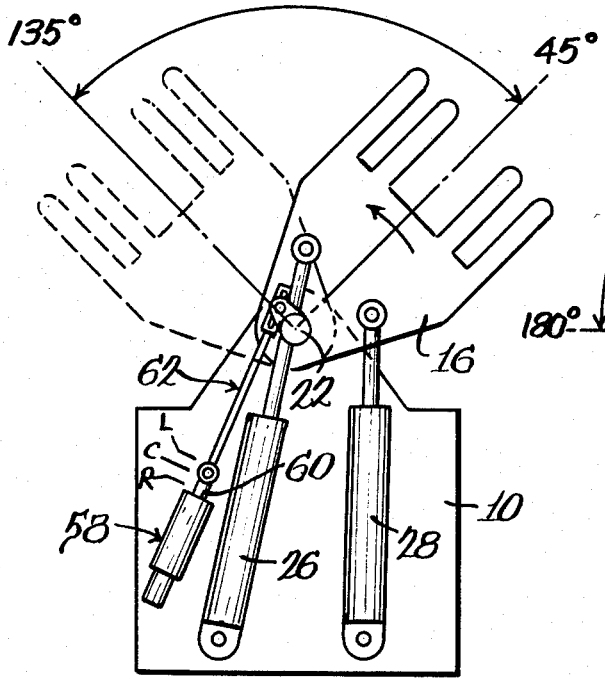
Figure 5C:
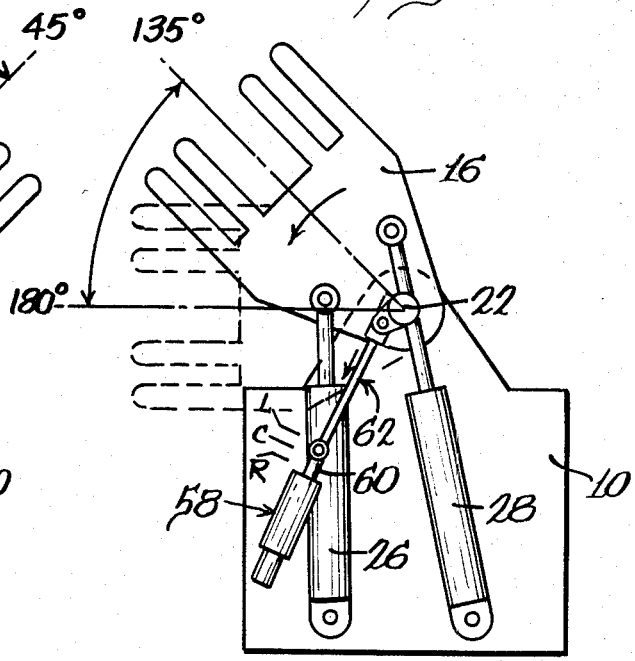

As will be appreciated by those familiar with the art, the relationship of hydraulic motors 26 and 28 with respect to the vertical swinging axis of boom assembly 12 as the boom assembly is pivoted from one end of its arc of travel to the other has a significant effect on the operational characteristics of the swing mechanism. FIGS. 5A–C illustrate the orientation of hydraulic motors 26 and 28 as they pivot boom assembly 12 counterclockwise through its full arc of travel (only swing tower 16 of boom assembly 12 is illustrated in these figures for clarity). Clockwise movement of the boom assembly through its arc of travel is achieved in essentially the same manner a counterclockwise movement, with reversal of fluid pressures within the swing mechanism.

With reference to FIG. 5A, the orientation of motors 26 and 28 is illustrated with boom assembly 12 at the extreme right hand end of its arc of swinging movement. It will be observed that in this position of the boom assembly, hydraulic motor 26 is in an overcenter condition, i.e., it is less than fully extended, and will move to its fully extended, center position when the boom assembly is moved away from its travel stop and the centerline of hydraulic motor 26 intersects the vertical swinging axis of the boom assembly (defined by upper pivot 22 illustrated in FIG. 5A). In initiating swinging movement of boom assembly 12 from the end of its arc of travel to the position illustrated in phantom in FIG. 5A, the head end of hydraulic motor 28 is pressurized, with motor 28 acting through a greater moment arm on swing tower 16 than hydraulic motor 26. Thus, motor 28 provides the primary force in pivoting the boom assembly away from its travel stop. Unlike backhoe swing mechanisms heretofore known, the present arrangement permits hydraulic motor 26 to supply supplemental torque to boom assembly 12 by pressurization of both ends of motor 26, the difference in the effective piston surface area between the rod and head ends of the motor providing this supplemental torque. In previously known arrangements, hydraulic fluid porting in this manner was typically not provided, and consequently the hydraulic motor providing the primary motor force for movement of the boom assembly would be arranged to overcome a negative torque exerted on the swing tower by the other, overcenter hydraulic motor of the swing mechanism. Porting hydraulic fluid to the hydraulic motors in the manner of the present arrangement, as will be more fully described, provides the operator of the backhoe with improved control, and provides a more efficient swing mechanism for operation of the boom assembly of the backhoe.

As illustrated in FIG. 5B, hydraulic motor 26 moves through its center position as the boom assembly 12 is pivoted counterclockwise toward the central portion of its arc of travel (approximately 90 degrees). As the boom assembly of the backhoe is moved through this central portion of its arc of travel, each of hydraulic motors 26 and 28 is in a non-overcenter condition with each motor supplying substantial motive force to the boom assembly as it is pivoted. As illustrated, hydraulic motor 28 continues to extend, while hydraulic motor 26 begins to contract after moving through its fully extended, center position. During counterclockwise movement through this central portion of the range of travel of the boom assembly, the present hydraulic swinging mechanism is arranged to continue to direct hydraulic fluid under pressure to the rod end of hydraulic motor 26, and to the head end of hydraulic motor 28. Simultaneously, the other ends of the hydraulic motors are placed in fluid communication with the fluid reservoir of the hydraulic system.

FIG. 5C illustrates the orientation of hydraulic motors 26 and 28 as hydraulic motor 28 moves through its center position and boom assembly 12 is moved toward the other end of its arc of swinging movement. As hydraulic motor 28 moves to and beyond its center position, it goes overcenter and begins to contract, while contraction of hydraulic motor 26 by continued pressurization of its rod end further pivots the boom assembly toward its travel stop. In order to hydraulically cushion the movement of the boom assembly as it approaches its travel stop, the operation of the present swing mechanism provides restriction of the fluid flow from both of the head ends of hydraulic motors 26 and 28, this result being achieved without the use of conventionally known motor-mounted stingers or orifices.

Figure 4:
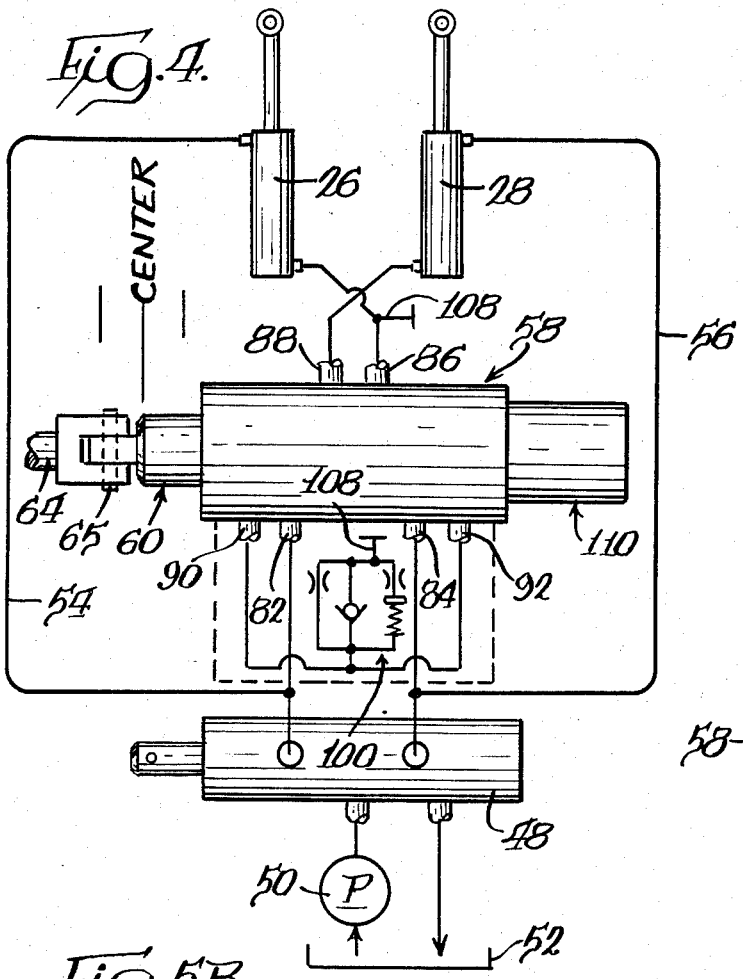
FIG. 4 is a diagrammatic view illustrating the hydraulic system of the present swing mechanism.

FIG. 4 diagrammatically illustrates the hydraulic system of the present swing mechanism. A directional flow control valve 48 is connected with a suitable linkage (not shown) for selective operation by the backhoe operator. The control valve 48 selectively directs hydraulic fluid under pressure from the hydraulic fluid pump 50 which draws hydraulic fluid from a fluid sump or reservoir 52. Control valve 48 operates to direct return fluid flow from the swing mechanism to the reservoir 52. As shown, control valve 48 is in respective fluid communication with the rod ends of hydraulic motors 26 and 28 via fluid conduits 54 and 56.

Figure 2:
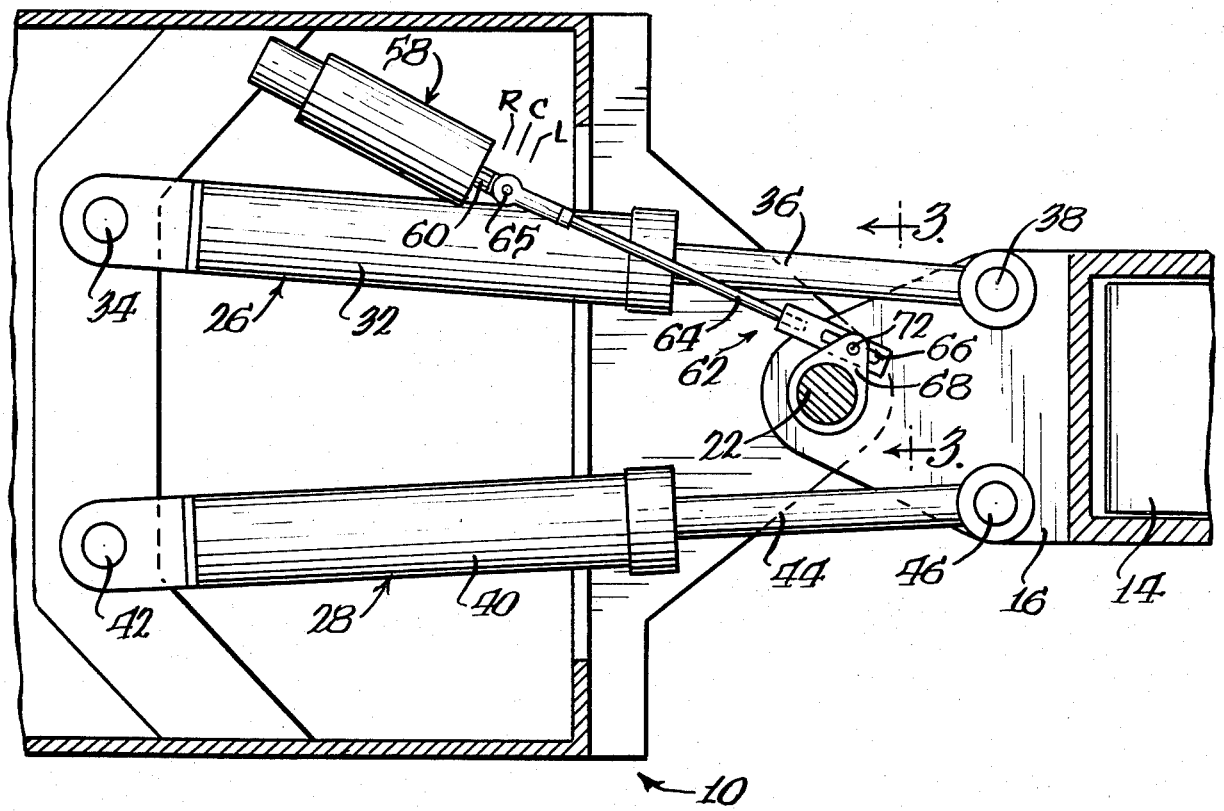
FIG. 2 is a view taken generally along lines 2—2 of FIG. 1 illustrating the orientation of the present swing mechanism to the backhoe frame and boom assembly.

The present swing mechanism further includes a hydraulic sequencing valve 58 hydraulically joined in fluid communication with the ends of hydraulic motors 26 and 28, and disposed in fluid communication between the head ends of motors 26 and 28 and flow control valve 48. Sequencing valve 58 includes a multi-position, self-centering valve spool 60 which, as is best illustrated in FIG. 2, is operatively connected with boom assembly 12 by a valve control linkage 62. The preferred configuration of sequencing valve 58 and its operation will be more fully discussed.

Figure 3:
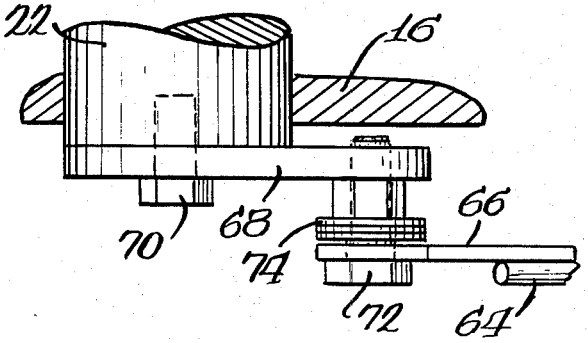
FIG. 3 is an enlarged detailed view taken generally along lines 3—3 of FIG. 2.

Valve control linkage 62 extends between sequencing valve 58 and boom assembly 12. Control linkage 62 cooperates with the sequencing valve 58 and swing tower 16 in order to effect redirection of hydraulic fluid to and from the head ends of hydraulic motors 26 and 28 as the boom assembly is moved through its arc of swinging movement. As best illustrated in FIGS. 2 and 3, control linkage 62 includes an elongated link 64 having a first end portion pivotally connected with valve spool 60 by a pivot 65. The second end portion of link 64 is provided with a slotted plate 66 affixed thereto. Slotted plate 66 is adapted to receive a pin 72 which is supported by a pivot arm 68. Pivot arm 68 is affixed to upper pivot 22 by a fastener 70 for rotational movement of pivot arm 68 with the upper pivot 22. Spacers 74 are provided on pin 72 so that slotted plate 66 is maintained in position slightly below upper pivot 22.

Movement of pin 72 coincident with rotation of boom assembly 12 about its vertical swinging axis cooperates with link 64 and slotted plate 66 for operation of self-centering valve spool 60 of sequencing valve 58. Significantly, pin 72 and slotted plate 66 cooperate to effect a lost motion action for operation of the sequencing valve. Essentially, this action is such that the self-centering valve spool 60 moves from either its right-hand or left-hand positions (designated "R" and "L", respectively) toward its center position (designated "C") as the boom assembly is pivoted through the end portions of its arc of travel away from the travel stops, with one or the other of hydraulic motors 26 and 28 in an overcenter condition. Conversely, valve control linkage 62 operates valve spool 60 against its self-centering mechanism when the boom assembly is moved through end portions of its arc of travel toward its travel stops, with one of the hydraulic motors in an overcenter condition. The lost motion nature of valve control linkage 62 permits valve spool 60 to remain or "dwell" in its center position as the boom assembly 12 is moved by hydraulic motors 26 and 28 through the central portion of the arc of travel.

Other suitable lost motion mechanisms could also be used. The arrangement disclosed could be altered by providing pivot arm 68 with a slotted portion adapted to receive a suitably shaped pin affixed to line 64. Essentially, the lost motion mechanism comprises slot means connected to one of the second end portion of link 64 and pivot arm 68, the slot means being adapted to receive pin means on the other of the second end portion of link 64 and pivot arm 68.

The changes in the position of valve spool 60 by valve control linkage 62 are illustrated in FIGS. 5A–C. As shown in FIG. 5A, where counterclockwise swinging movement of the boom assembly away from its travel stop is being initiated, valve control linkage 62 cooperates with the self centering spool valve 60 to move the valve spool from its left-hand position (illustrated in FIG. 5A) toward its center position (note the position of valve spool 60 in FIG. 5B). As boom assembly 12 is rotated by the hydraulic motors through the end portion of its arc of travel as illustrated in FIG. 5A, control linkage 62 operates self-centering valve spool 60 in a generally continuous fashion between the left-hand and center positions of the valve spool.

As illustrated in FIG. 5B, self-centering valve spool 60 is maintained in its center position as boom assembly 12 is pivoted by hydraulic motors 26 and 28 through the central portion of its arc of travel. In this way, valve control linkage 62 provides a suitable dwell period in which there is no relative movement of valve spool 60 of sequencing valve 58.

As shown in FIG. 5C, hyraulic motors 26 and 28 continue to rotate boom assembly 12 toward its travel stop as hydraulic motor 28 goes through its fully extended center position. As this motor goes overcenter and both motors 26 and 28 contract as the boom assembly is moved toward its travel stop, valve control linkage 62 continually moves valve spool 60 from its center position toward its right-hand position. As illustrated in FIG. 5C, valve spool 60 is shown in its center position since the valve spool is moved from its center position to its right-hand position as boom assembly 12 is pivoted through the end portion of its arc of travel toward its travel stop.

During clockwise movement of the boom assembly through its arc of travel, the operation of valve spool 60 by valve control linkage 62 is essentially reversed. When the boom assembly moves from the position shown in phantom in FIG. 5C to the position shown in solid line, valve spool 60 shifts from its right-hand position to its center position. The valve spool 60 is maintained in its center position as the boom assembly moves through the central portion of its arc of travel. The valve spool 60 is shifted from its center position toward its left-hand position as the boom assembly moves clockwise from the position illustrated in phantom in FIG. 5A toward its travel stop.

Thus, it will be appreciated that valve control linkage operates sequencing valve 58 so that porting of hydraulic fluid to the motors 26 and 28 is altered as boom assembly 12 is moved by the motors through its full range of swinging movement. It should be noted, however, that the exact timing for the operation of sequencing valve 58 is a matter of design choice, and may be readily altered by providing various configurations for valve control linkage 62.

With reference to FIGS. 4, and 6A–C, the preferred construction of self-centering sequencing valve 58 and its associated hydraulic cushioning circuit are illustrated. Sequencing spool valve 58 includes a valve body 80 which defines an interior bore 81 within which valve spool 60 is reciprocably disposed. The valve body 80 defines a plurality of fluid flow valve passages which communicate with the interior bore, the operation of valve spool 60 providing selective fluid communication between the valve passages.

Sequencing valve 58 is joined in fluid communication with control valve 48 via first and second valve passages 82 and 84. These valve passages provide fluid communication between the sequencing valve and the rod ends of hydraulic motors 26 and 28, respectively, via conduits 54 and 56. Third and fourth valve passages 86 and 88 respectively connect sequencing valve 58 in fluid communication with the head ends of hydraulic motors 26 and 28. As noted, sequencing valve 58 is thus provided in fluid communication between the rod ends and the head ends of hydraulic motors 26 and 28, and between the head ends of the hydraulic motors and control valve 48.

Valve body 80 of sequencing valve 58 further defines fifth and sixth valve passages 90 and 92 which are in fluid communication with each other by a passage 94. As indicated by phantom line in the drawings, it is contemplated that passage 94, as well as the hydraulic cushioning circuit associated with the sequencing valve, are preferably incorporated into the body of the sequencing valve. However it will be appreciated that various arrangements may be employed in order to operatively connect the sequencing valve with the other components of the hydraulic swing mechanism.

In order to provide selective fluid communication between the valve passages defined by valve body 80, valve spool 60 includes a circumferential land 96 which separates and defines first and second recessed areas 97 and 98. Depending upon the position of valve spool 60 within the valve body, at least two of the valve passages defined by the valve body communicating with its interior bore 81 are joined in fluid communication.

In order to effect hydraulic cushioning of the boom assembly as its approaches its travel stops, a hyraulic cushioning circuit 100 is hydraulically joined and associated with the sequencing valve 58. In the preferred embodiment, hydraulic cushioning circuit 100 is disposed in fluid flow communication between the fifth and sixth valve passages 90 and 92 communicating with each other, and one or the other of third and fourth valve passages 86 and 88 which communicate with the head ends of hydraulic motors 26 and 28.

The cushioning circuit includes, disposed in parallel flow relation, a fluid flow restricting orifice 102, a one-way check valve 104, and an orificed relief valve 106. As shown schematically, a passage 108 connects one end of cushioning circuit 100 with third valve passage 86. As noted, passage 108 could instead be connected with fourth valve passage 88, or if desired could instead be in communication with interior bore 81 in a position aligned axially with one of valve passages 86 or 88.

It should be noted that the essential feature of hydraulic cushioning circuit 100 is the provision of a fluid flow restrictor and a one way check valve in parallel flow with each other. In this way, substantially unrestricted hydraulic fluid flow is permitted through the cushioning circuit to the head ends of hydraulic motors 26 and 28, while fluid flow from the head ends of the hydraulic motors through the cushioning circuit is restricted to effect hydraulic cushioning of the motors and the boom assembly. While the inclusion of a flow restricting orifice and orificed relief valve in parallel flow with each other is preferred, it will be appreciated that many of the benefits of the present hydraulic swing mechanism may be derived by providing a cushioning circuit in accordance with the teachings of the present invention having a flow restrictor and a one-way check valve arranged in parallel flow relation each with other.

As previously noted, valve spool 60 is provided with a self-centering mechanism so that the valve spool is continually urged from its left-hand or right-hand positions toward its center position. As best illustrated in FIG. 6B, a spool centering mechanism 110 is provided at one end of interior bore 81 within valve body 80. Centering mechanism 110 includes a housing 112, which may be threadably received by valve body 80 to facilitate assembly and disassembly of the sequencing valve. Valve spool 60 includes a reduced spool portion 114 which is distinguished from the remainder of the valve spool by shoulder 116.

Centering mechanism 110 includes a pair of opposed spring keeper elements 118 and 120 which are respectively disposed upon reduced spool portion 114 in opposed relation. A centering spring 122, preferably comprising a coil spring, is disposed in captive relation between keeper elements 118 and 120, and provides spring force for urging valve spool 60 toward its center position. Keeper elements 118 and 120 respectively cooperate with shoulder 116 and a snap ring 124 for maintaining centering spring 122 in the desired captive fashion.

A spacer 126 disposed between keeper elements 118 and 120 limit the movement of the keeper elements to a distance "x" with respect to each other. It will be appreciated that distance "x" is the maximum permissible travel of valve spool 60 toward either its right-hand or left-hand positions from its center position. When valve spool 60 is moved from its center position illustrated in FIG. 6B to its left-hand position illustrated in FIG. 6A, keeper element 120 is moved toward keeper element 118 against the force of centering spring 122. Similarly, when valve spool 60 is moved from its center position to its right-hand position illustrated in FIG. 6C, keeper element 118 is moved toward keeper element 120 against the force of centering spring 122. Spool centering mechanism 110 cooperates with previously described valve control linkage 62 to provide sequential operation of sequencing valve 58 in order to effect operation of the present swing mechanism in the following manner.

As discussed, hydraulic motors 26 and 28 move through various operational modes as boom assembly 12 is pivoted about its vertical axis from one end of its arc of travel to the other. The operation of the present swing mechanism will first be described as the boom assembly is moved counterclockwise from the position illustrated in solid line FIG. 5A to the position illustrated in phantom in FIG. 5C. During movement through the arc, the present swing mechanism operates so that: first, motor 28 develops the primary motor force for pivoting the boom assembly, while motor 26 provides a supplementary force as it moves from its overcenter position; second, each hydraulic motor 26 and 28 supplies substantial motive force for pivoting the boom assembly through the central portion of its arc of travel while neither of the motors is overcenter; and, third, hydraulic motor 26 provides motive force for pivoting the boom assembly toward its travel stop through the end portion of its arc of travel, while hydraulic fluid flow from both head ends of hydraulic motors 26 and 28 is restricted to effect hydraulic cushioning of the boom assembly.

Figure 6A:
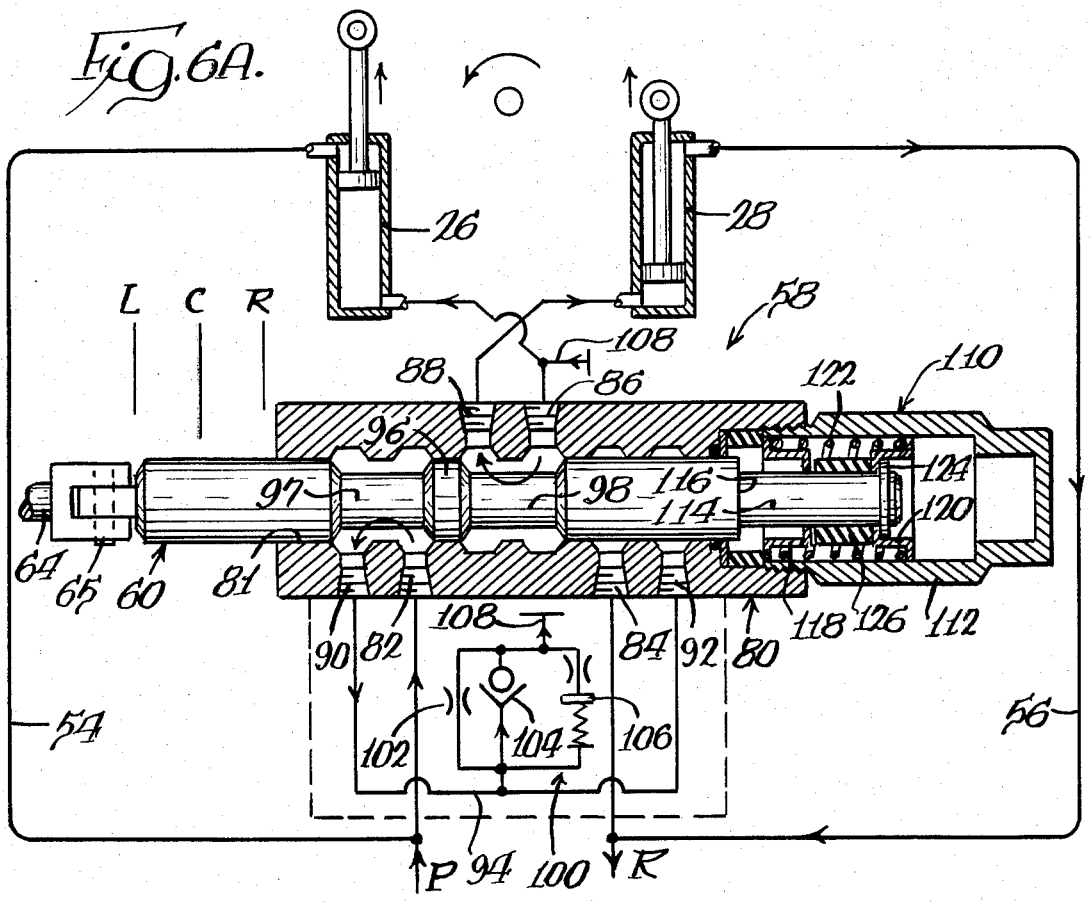
FIGS. 6A–6C are diagrammatic cutaway views illustrating the hydraulic operation of the present swing mechanism in pivoting the backhoe boom assembly to the range of motion illustrated in FIGS. 5A–C.
Figure 6B:
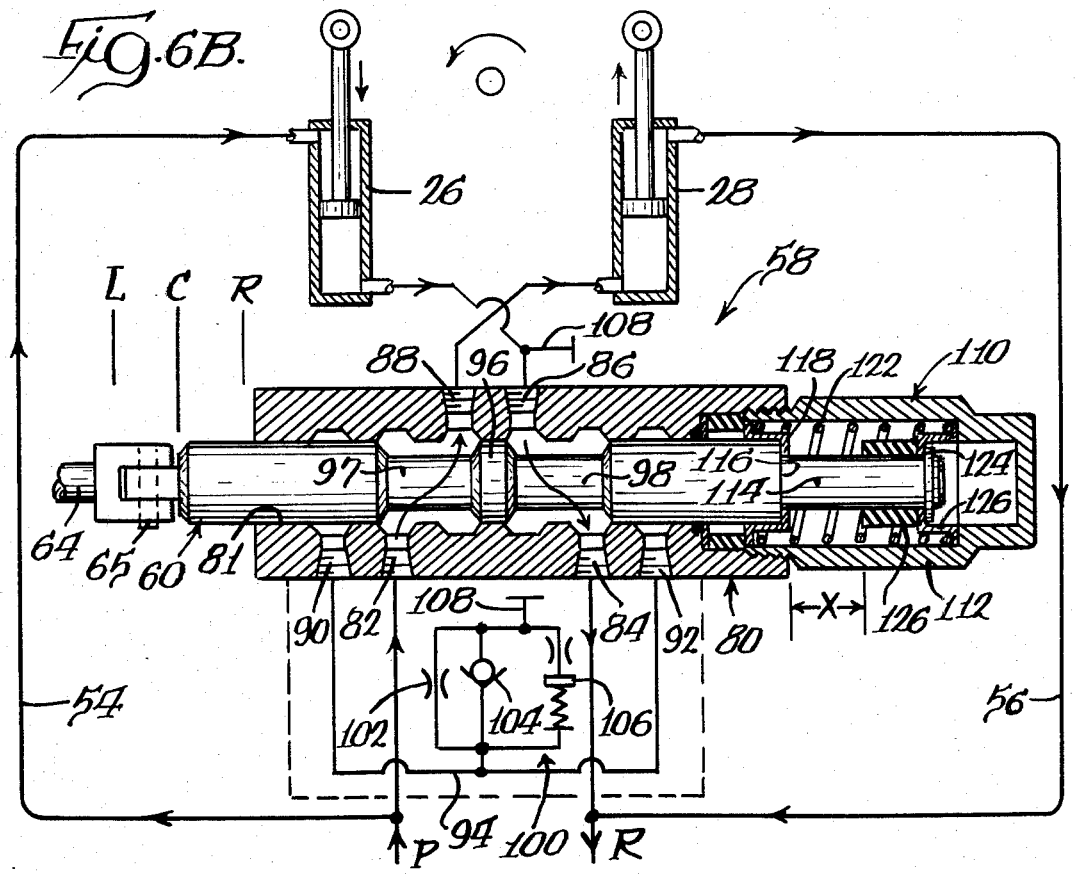

FIG. 6A illustrates hydraulic fluid flow within the swing mechanism when the boom assembly is at one end of its arc of travel as illustrated in FIG. 5A, and counterclockwise movement of the boom assembly away from its travel stop is being initated. As shown, valve control linkage 62 acts against centering spring 122 to position valve spool 60 in its left-hand position. Motor 26 is illustrated in its overcenter condition, with both motors 26 and 28 extending as they move the boom assembly away from its travel stop. It will be noted that control valve 48 is not illustrated in FIGS. 6A–C, with the position of the control valve designated by the symbols "P" and "R" indicating direction of hydraulic fluid flow from pump 50 ("P") and to reservoir 52 ("R") through control valve 48.

As shown in FIG. 6A, pressurized hydraulic fluid is ported to the rod end of hydraulic motor 26 by conduit 54. At the same time, sequencing valve 58 provides fluid communication between the rod end of motor 26 and the head ends of both motors 26 and 28. As shown, pressurized flow enters sequencing valve 58 through valve passage 82 which is in communication with valve passage 90 across first recessed area 97 of the valve spool 60. Pressurized fluid flow from valve passage 90 flows to hydraulic cushioning circuit 100 via passage 94, and flows through the cushioning circuit substantially unrestricted by way of check valve 104. Fluid flow from the cushioning circuit is directed by passage 108 to valve passage 86.

As shown, valve passages 86 and 88, respectively connected with the head ends of motors 26 and 28, are in communication with each other across second recessed area 98 of valve spool 60. In essence, sequencing valve 58 provides fluid communication between the rod end of motor 26, and the cylinder ends of motors 26 and 28 across the hydraulic cushioning circuit 100. In this way, motor 28 provides the primary motive force for movement of boom assembly 12 away from its travel stop, while pressurization of both ends of hydraulic motor 26 permits this motor to exert supplemental motive force upon the boom assembly for initiating the swinging movement thereof. Thus, both motors 26 and 28 begin to extend, with fluid flow from the rod end of motor 28 being directed to the reservoir of the hydraulic system via conduit 56. It will be noted that even though the rod end of motor 26 is pressurized, fluid will flow from the rod end of this motor since it is extending.

As boom assembly 12 is pivoted counterclockwise by the hydraulic motors 26 and 28 through the end portion of its arc of travel illustrated in FIG. 5A, valve control linkage 62 cooperates with spool centering mechanism 110 to shift valve spool 60 toward its center position. As will be appreciated by those familiar with the art, circumferential land 96 of valve spool 60 may be provided with suitable metering grooves or the like so that a certain transitional period is provided between the respective positions of valve spool 60 of sequencing valve 58.

As illustrated in FIG. 6B, sequencing valve 58 is shown with its valve spool 60 in its center position. Valve spool 60 is maintained in its center position as hydraulic motors 26 and 28 pivot boom assembly 12 through the central portion of its arc of travel (illustrated in FIG. 5B). During movement of the boom assembly through this portion of the arc, neither of the motors 26 and 28 is in an overcenter condition, and thus fluid under pressure is directed to opposite ends of the hydraulic motors so that hydraulic motor 26 contracts as hydraulic motor 28 continues to extend.

In order to provide operation of motors 26 and 28 in this fashion, the positioning of valve spool 60 within valve body 80 provides fluid communication between the rod end of motor 26 and the head end of motor 28, and fluid communication between the head end of motor 26 and the rod end of motor 28 for return fluid flow to the reservoir of the hydraulic system. As illustrated in FIG. 6B, pressurized fluid is directed to the rod end of motor 26 through conduit 54. Pressurized fluid also flows from valve passage 82 to valve passage 88 across recessed area 97 of the valve spool to the head end of motor 28. Fluid is returned to the hydraulic fluid reservoir from the rod end of motor 28 through conduit 56, while fluid returned from the head end of motor 26 flows through valve passage 86, across recessed area 98 to valve passage 84, and into the hydraulic fluid reservoir. Thus, as the boom assembly is pivoted through the range of motion illustrated in FIG. 5B, hydraulic motor 26 contracts and hydraulic motor 28 extends. As previously noted, the lost motion nature of control linkage 62 permits valve spool 60 to remain in its center position as the boom assembly is moved through the central portion of its arc of travel. During this operational mode, there is essentially no fluid flow through the hydraulic cushioning circuit 100.

Figure 6C:
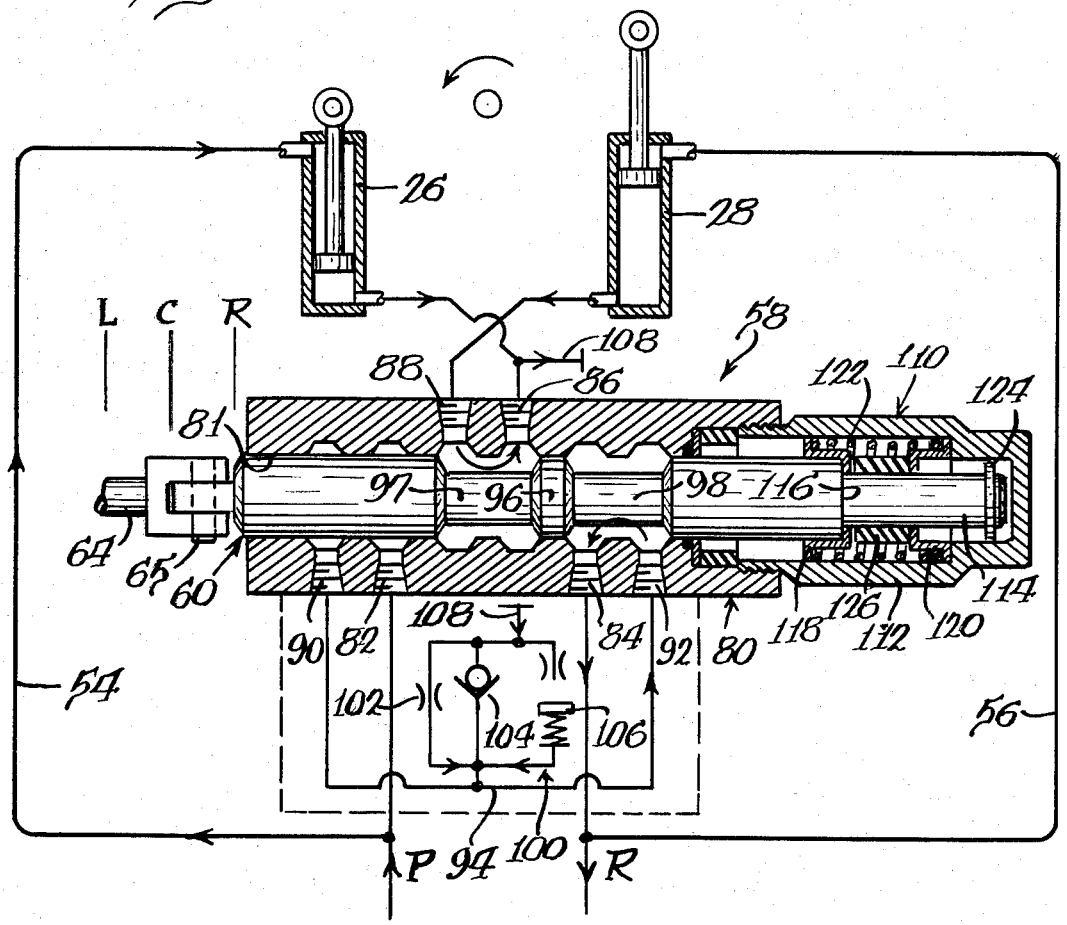

As boom assembly 12 is moved through the position illustrated in solid line in FIG. 5C, hydraulic motor 28 moves through its center position and valve control linkage 62 begins to move valve spool 60 of sequencing valve 58 toward its right-hand position, illustrated in FIG. 6C. It will be noted that the position of the valve spool 60 as shown in FIG. 6C corresponds to the position of boom assembly 12 illustrated in phantom line in FIG. 5C. Thus, as the boom assembly is moved counterclockwise through this end portion of its arc of travel toward the travel stop, the valve control linkage 62 moves valve spool 60 from its center position toward its right-hand position. Movement of the valve spool in this fashion effects hydraulic cushioning of hydraulic motors 26 and 28 by restricting fluid flow from both of the head ends of the motors. This provides a significant improvement in hydraulic cushioning over arrangements heretofore known, since previous arrangements typically restricted fluid flow from only one of the hydraulic motors of the swing mechanism, thus mandating higher peak cushioning pressures within the system.

As valve spool 60 is moved toward the position illustrated in FIG. 6C against the force of centering spring 122 by valve control linkage 62, fluid communication is provided between the head ends of hydraulic motors 26 and 28 and the rod end of hydralic motor 28 across hydraulic cushioning circuit 100. As noted, circumferential land 96 may be provided with metering grooves so that full hydrualic cushioning of the motors is not affected until some time after hydraulic motor 28 goes into its overcenter condition. For example, full hydraulic cushioning may not be effected until approximately the final 32–35 degrees of pivoting movement of the boom assembly toward its travel stop.

FIG. 6C illustrates the flow of hydraulic fluid within the swing mechanism to effect hydraulic cushioning in the desired fashion. As shown, fluid under pressure is continued to be directed to the rod end of motor 26, which provides the primary motive force for moving the boom assembly through the end portion of its arc of travel toward its travel stop. Simultaneously, the head ends of motors 26 and 28 are placed in fluid communication with each other by fluid communication between valve passages 86 and 88 across recessed area 97 of valve spool 60. Communication of the head ends of the motors with each other in this fashion permits direction of fluid flow from the head ends of both motors through hydraulic cushioning circuit 100.

As shown, fluid flow from the head ends of both motors is directed through passage 108 to the cushioning circuit 100. Cushioning back pressure within the cushioning circuit is initially created by restriction of fluid flow through orifice 102. Typically, orifice 102 may provide for the creation of cushioning back pressure up to approximately 800 pounds per square inch (psi). When back pressure within the cushioning circuit reaches a predetermined pressure, relief valve 106 opens, with its orifice further creating back pressure within the cushioning circuit. Orificed relief valve 106 may typically provide cushioning back pressure up to approximately 3500 psi. It is to be noted that hydraulic cushioning circuit 100 necessarily includes a flow restricting device, such as orifice 102, which permits flow through the cushioning circuit even if fluid flow into the circuit is relatively small. Otherwise, there may be some periods of operation during which flow of fluid into the cushioning circuit would be insufficient to open relief valve 106, thus resulting in an undesired state of fluid lock within the swing mechanism.

Fluid flow from hydraulic motors 26 and 28 through the cushioning circuit 100 passes through passage 94 to valve passages 92 and 84 across second recessed area 98 of valve spool 60. Fluid flow is then directed to the hydraulic fluid reservoir of the system through directional control valve 48. During movement of the boom assembly through this end portion of its arc of travel toward the travel stop, both hydraulic motors 26 and 28 are contracting, with motor 28 in its overcenter condition.

Thus, the operation of sequencing valve 58 and its associated hydraulic cushioning circuit 100 significantly improves the operational characteristics of the swing mechanism for rotating the boom assembly of the backhoe. As the boom assembly is moved counterclockwise from one end of its arc of travel to the other as described above, the system operates so that hydraulic motor 28 first applies the primary motive force for movement of the boom assembly, with overcenter motor 26 providing supplementary force; then each motor 26 and 28 supplies substantial motive force for movement of the boom assembly; and then motor 26 provides the motive force for movement of the boom assembly, with fluid from the head ends of both motors 26 and 28 being directed through the flow restricting hydraulic cushioning circuit 100 as the boom assembly approaches its travel stop in a smooth and controlled fashion.

While operation of the present swing mechanism has been described during movement of boom assembly 12 through its arc of travel in a counterclockwise direction (with the orientation of FIGS. 2 and 5A–C) it will be appreciated that manipulation of control valve 48 to reverse hydraulic fluid pressure within the system results in clockwise operation of the swing mechanism in a essentially similar fashion, with the reversal of fluid pressures within the system from those illustrated.

With boom assembly 12 positioned as illustrated in phantom line in FIG. 5C, control valve 48 is manipulated to reverse fluid pressure within the hydraulic system in order to move boom assembly 12 in a clockwise direction. In other words, the designations "P" and "R" indicating connections with the pump and reservoir of the hydraulic system would be reversed in FIGS. 6A–C when boom assembly 12 is pivoted clockwise, with corresponding reversal of fluid pressures within the system.

When boom assembly 12 is positioned as shown in phantom line in FIG. 5C, valve spool 60 of sequencing valve 58 is in its left-hand position as illustrated in FIG. 6C. Fluid under pressure is directed to the rod end of hydraulic motor 28 through conduit 56, with pressurized fluid flowing through valve passages 84 and 92 across recessed area 98 of valve spool 60, and through check valve 104 of cushioning circuit 100. Fluid flow through the check valve is directed to both head ends of hydraulic motors 26 and 28 via valve passages 108, 86 and 88, with valve passages 86 and 88 being in communication with each other across first recessed area 97 of valve spool 60. Flow from the rod end of hydraulic motor 26 is directed through control valve 48 to fluid reservoir 52. Thus, in initiating clockwise swinging movement of the boom assembly, hydraulic motor 26 provides the primary motive force, while overcenter hydraulic motor 28 provides supplementary motive force.

As motors 26 and 28 rotate boom assembly 12 clockwise to the position illustrated in phantom line in FIG. 5B, valve control linkage 62 cooperates with self-centering valve spool 60 to shift the valve spool from its left-hand to its center position. The center position of valve spool 60 is illustrated in FIG. 6B, with hydraulic fluid flow in the system reversed from that shown during clockwise swinging movement. Pressurized hydraulic fluid is directed to the rod end of hydraulic motor 28 through conduit 56, and to the head end of motor 26 through valve passages 84 and 86 across recessed area 98. Return fluid flow from the rod end of motor 26 is directed through control valve 48 to reservoir 52, together with flow from the head end of motor 28 via valve passages 88 and 82 across recessed area 97. Thus, as hydraulic motors 26 and 28 pivot the boom assembly 12 through its central portion of its arc of travel, when neither of the motors is overcenter, opposite ends of the hydraulic motors are pressurized so that each provides substantial force for pivoting the boom assembly. Valve spool 60 is maintained in its center position by centering mechanism 110, with valve control linkage 62 providing a suitable dwell period for the valve spool as motors 26 and 28 pivot the boom assembly through the central portion of its arc of travel.

As clockwise rotation of boom assembly continues to the position illustrated in phantom line in FIG. 5A, hydraulic motor 26 moves to its center, fully-extended position. As the boom assembly continues to be moved, motor 26 goes overcenter, and valve control linkage 62 begins to shift valve spool 60 of sequencing valve 58 toward its left-hand position, illustrated in FIG. 6A. As the position of valve spool 60 is shifted, hydraulic motor 28 provides the primary motive force for pivoting the boom assembly, while hydraulic fluid from the head ends of both motors 26 and 28 is directed through and restricted by hydraulic cushioning circuit 100. In this way, hydraulic cushioning of the motors is effected to cushion the movement of the boom assembly as it approaches its travel stop. As valve spool 60 is moved into its left-hand position, the head ends of motors 26 and 28 are placed in fluid communication via valve passages 86 and 88 communicating across recessed area 98. Flow from the head ends of both motors is directed through valve passage 108 to cushioning circuit 100, where initial cushioning back pressure is created by flow restricting orifice 102. As back pressure within the cushioning circuit increases, relief valve 106 opens to effect full hydraulic cushioning of the boom assembly as it approaches its travel stop.

The advantages of the above-described hydraulic swing mechanism will be readily appreciated by those familiar with the art. The provision of a single hydraulic cushioning circuit which serves to cushion both hydraulic motors of the swing mechanism as the boom assembly approaches either end of its arc of travel represents a significant improvement over conventionally known swing mechanism arrangements. Clearly, the elimination of stingers and/or orifices from the cylinders of the hydraulic motors significantly reduces both fabrication and maintenance expenses. Additionally, the removal of the usual orifices from each of the motors improves the overall efficiency of the system, since orifices of this type restrict fluid flow and generate back pressure at undesired times, and generally act to increase the temperature of hydraulic fluid in the system. Further, the removal of the usual orifices from each hydraulic motor increases the acceleration and average top speed of the boom assembly. Thus, swing time and energy loss are decreased while productivity of the backhoe is increased.

An additional benefit of the present system relates to a decrease in peak cushioning back pressures created. Since the typical cushioning arrangement heretofore known for swing mechanisms provided hydraulic cushioning by restricting fluid flow from only one of the hydraulic motors in the system, relatively high cushioning back pressure is created. In contrast, the present system substantially reduces peak cushioning back pressures since hydraulic fluid flow from the head ends of both hydraulic motors is restricted. This provides the same amount of hydraulic cushioning for the boom assembly, while greatly enhancing the reliability of the entire mechanism.

Notably, the use of a single flow restricting cushioning circuit for effecting hydraulic cushioning of both motors eliminates inconsistencies in cushioning which may exist in conventionally known systems in which restriction of fluid from one motor or the other effects cushioning at one end of the arc of travel or the other. In conventional systems, minor variations in the respective cushioning mechanisms of the hydraulic motors may result in inconsistent cushioning at the opposite ends of arc of the travel of the boom assembly. Further, the cushioning effect provided by the present system may be readily altered for adapting the system for use with various boom-supported implements. Cushioning may be changed by altering the size of orifice 102, by adjusting relief valve 106 (if adjustable in nature), or by changing the size of the orifice of relief valve 106.

A further benefit of the present swing mechanism relates to the improved torque characteristics provided by the system. Naturally, improvement of the torque characteristics in and of itself permits better control of boom assembly by the backhoe operator. Additionally, the improvement in the torque characteristics provides greater flexibility in the selection of the type of hydraulic motors used in the swing mechanism. In current arrangements, it has been typically necessary to employ trunion-mounted hydraulic motors in order to achieve a range of swinging movement of the boom assembly equal to approximately 180 degrees. This is because end-mounted hydraulic motors, which are typically less costly, cannot be readily mounted to provide as wide a range of motion in a conventionally ported system. When conventionally ported end-mounted motors are employed, the geometry of the system is usually such that the negative torque applied to the boom assembly when one of the motors is in its overcenter configuration cannot be sufficiently overcome by the non-overcenter motor to permit a range of motion in excess of approximately 160–170 degrees. Since the present swing mechanism obviates the problem heretofore associated with the application of this negative force to the boom assembly, end-mounted hydraulic motors may be readily employed without detriment to the available range of pivoting movement of the boom assembly. This represents a further distinct improvement upon previously known mechanisms.

From the foregoing, it will be observed that numerous variations and modifications may be affected without departing from the true spirit and scope of the novel concept for the present invention. It will be understood that no limitation with respect to the specific apparatus illustrated herein is intended or should be inferred. It is, of course, intended to cover by the appended claims all such modifications as follow in the scope of the claims.

What is claimed is:

1. For an implement having a frame supporting a boom assembly for pivotal movement about a vertical axis, an arrangement for pivoting said boom assembly relative to said frame through an arc comprising:

a pair of hydraulic motors interconnected between said frame and said boom assembly, each motor having first and second ends defining respective expansible fluid chambers, the extension and contraction of said motors pivoting said boom assembly about said vertical axis, each of said motors being fully extended when its respective centerline intersects said vertical axis;

a hydraulic system including a source of fluid under pressure and directional control valve means for selectively directing fluid under pressure from said source to the first end of each of the hydraulic motors, sequencing valve means, comprising a multi-position spool valve and hydraulic cushioning means, hydraulically joined between the second ends of the hydraulic motors and said control valve means, said spool valve being sequentially positionable in first, second, and third positions, valve control means comprising linkage means including lost-motion means, connecting said sequencing valve means directly with said boom assembly at said vertical axis thereof whereby pivotal movement of said boom assembly through said arc operates said sequencing valve means via said lost-motion means to alter hydraulic fluid flow between the second ends of said motors and said directional control valve means, and centering means for urging said spool valve from either of said first and third positions toward said second position, said linkage means operating to reposition said spool valve from said second position to either of said first and third positions and cooperating with said centering means to maintain said spool valve in said second position as said boom assembly is moved through a central portion of said arc.

2. The arrangement for pivoting a boom assembly in accordance with claim 1, wherein said linkage means comprises a link having a first portion pivotally connected to said spool valve, and said lost motion means comprises slot means connected to one of a second portion of said link spaced from the first portion and said boom assembly, said slot means receiving and cooperating with pin means on the other of said second portion and said boom assembly for operation of said spool valve during movement of said boom assembly through said arc.

3. The arrangement for pivoting a boom assembly in accordance with claim 1, wherein said spool valve is positionable in:

said first position to provide fluid communication between the first end of one of said motors and the second ends of both of said motors;

said second position to provide fluid communication between the first end of said one motor and the second end of the other motor, and between the second end of the one motor and the first end of the other motor; and said third position to provide fluid communication between the first end of the other motor and the second ends of both of the motors, said valve control means operating said spool valve sequentially between the first, second and third positions as said motors pivot said boom assembly through said arc.

4. The arrangement for pivoting a boom assembly in accordance with claim 3 wherein said hydraulic cushioning means comprises one-way flow restricting means hydraulically joined to said spool valve, said restricting means restricting fluid flow through said sequencing valve means from the second ends of said motors, and permitting substantially unrestricted fluid flow to the second ends of said motors through said sequencing valve means, when said spool valve is in said first and third positions.

5. The arrangement for pivoting a boom assembly in accordance with claim 4, wherein said spool valve includes a valve body with an interior bore and a valve spool disposed within said bore connected with said linkage means, said valve defining a plurality of valve passages communicating with said bore, two of said passages communicating with the first ends of said motors, two of said passages communicating with the second ends of said motors, and two of said passages communicating with each other, said restricting means being in fluid communication between said two passages communicating with each other and one of said passages communicating with one of said second ends of said motors, whereby said valve spool is positionable to provide fluid communication between one of the first ends of said motors and the second ends of said motors across said restricting means in the first and third positions of said valve.

6. A hydraulic swing mechanism for pivotally moving a pivoted member relative to a fixed member about an axis through an arc, comprising:

a pair of hydraulic motors pivotally interconnected between said members, each motor having a rod end and a head end providing respective fluid expansible chambers, the extension and contraction of said motors pivoting said pivotal member relative to the fixed member, each motor being fully extended when its respective centerline intersects said axis, a hydraulic system including a source of fluid under pressure and direction control valve means for selectively porting fluid under pressure to the rod ends of said motors, sequencing valve means hydraulically joined between the rod and head ends of said motors comprising a multi-position spool valve and one-way flow restricting means, the rod end of one of said motors and the head ends of both motors being in fluid communication across said restricting means in a first position of said spool valve, the rod end of the one motor and the head end of the other of said motors, and the head end of said one motor and the rod end of the other motor being in respective fluid communication in a second position of said spool valve, the rod end of the other motor and the head ends of the motor being in fluid communication across said restricting means in a third position of said spool valve, valve control means comprising lost-motion linkage means, connecting said valve spool directly with said pivotal member at said pivotal axis thereof for sequentially operating said spool valve through said first, second, and third positions as said motors pivot said pivotal member from one end of said arc to the other, and centering means for urging said spool valve to said second position from either of said first and third positions, said lost motion linkage means being adapted to move said spool valve to either of said first and third positions from said second position, said linkage means cooperating with said centering means for maintaining said spool valve in the second position when said pivotal member is moved through a central portion of said arc.

7. The swing mechanism in accordance with claim 6, wherein said spool valve includes a valve body defining an interior bore and a plurality of valve passages communicating with said bore, and a valve spool disposed within said bore for providing selective communication between said valve passages, said plurality of valve passages including first and second passages respectively communicating with the rod ends of said motors, third and fourth passages respectively communicating with the head ends of said motors, and fifth and sixth passages communicating with each other, said restricting means being in fluid communication between said fifth and sixth passages, and one of said third and fourth passages, said first and fifth passages, and said third and fourth passages, being in respective fluid communication in said first position of said spool valve; said first and third passages, and second and fourth passages, being in respective fluid communication in the second position of said spool valve; and said second and sixth passages, and said third and fourth passages being in respective fluid communication in the third position of said spool valve.

8. The swing mechanism in accordance with claim 7, wherein said restricting means comprises one-way check valve means and flow restrictor means disposed in parallel flow relation, said one-way check valve permitting substantially unrestricted fluid flow to said head ends of said motors through said restricting means and said flow restrictor means restricting flow from the head ends of both said motors through said restricting means.

9. The swing mechanism in accordance with claim 8, wherein said valve control means operate said spool valve between said first and second positions generally when the centerline of one of said motors intersects said axis, and between said second and third positions generally when the centerline of the other of said hydraulic motors intersects said axis.

* * * * *